US006142193A

United States Patent [19]

Sanders

[11] Patent Number: 6,142,193

[45] Date of Patent: Nov. 7, 2000

[54] SELF VENTING MULTIPURPOSE FUNNEL

[76] Inventor: Thomas G. Sanders, 150 Rotary Rd., Huntington, W. Va. 25705-1060

[21] Appl. No.: 09/271,082

[22] Filed: Mar. 17, 1999

[51] Int. Cl.[7] ..... B65B 1/04

[52] U.S. Cl. ..... 141/300; 141/331

[58] Field of Search ..... 141/297–300, 141/331–345

[56] References Cited

U.S. PATENT DOCUMENTS 1,487,824 3/1924 Vincent .
1,612,383 12/1926 Lepeshkin .
1,676,986 7/1928 Sanders ..... 141/300

*Primary Examiner*—Steven O. Douglas
*Attorney, Agent, or Firm*—Stephoe & Johnson

[57] ABSTRACT

A funnel having a plurality of sections of varying diameter, a wide bottom opening and one or more outwardly protruding vertical ridges positioned on the exterior of the funnel. In the preferred embodiment, the sections of the funnel are of such a dimension, including a large top section and a short, wide spout, that the funnel provides more stability when filling a container having a wide opening. Also in the preferred embodiment, the vertical ridges extend from the top opening of the funnel to the bottom opening. When filling a container, the vertical ridges provide vents for the air in the container that is being replaced.

17 Claims, 4 Drawing Sheets

SELF VENTING MULTIPURPOSE FUNNEL

BACKGROUND OF THE INVENTION

1. Field of the Invention

This invention relates to funnels, and more specifically, to large capacity funnels having wide openings and are self-venting.

2. Related Art

Funnels are often used in the canning process of fruits, vegetables and meats. The canning process typically requires the canner to heat the processed food to extremely high temperatures prior to filling a canning jar or other storage container. Funnels are an obvious kitchen tool used by most canners to facilitate this process. However there are distinct disadvantages to using a conventional funnel during the canning process.

Conventional funnels are typically inverted hollow cones or tapering or cylindrical tubes having a wide opening at the top and a long narrow spout ending with a small opening at the bottom. Funnels are used to facilitate the pouring of liquids, powders, or any other filler material into containers that have a small opening. In operation, the small bottom opening of a funnel is placed into the opening of a container until the exterior sides of the funnel contact the rim of the container's opening, resulting in the funnel resting in the opening of the container. The funnel rests in the container's opening at that point where the diameter of the funnel equals the diameter of the opening of the container. Sometimes, however, the spout of a conventional funnel is too long and reaches the bottom of the container before contact is made between the sides of the funnel and the container opening. In this instance, the funnel is very unstable within the container and actually rocks back and forth which can cause the entire container/funnel to tip over or the contents to spill out of the funnel.

One disadvantage of using a conventional funnel during canning is that canning jars typically have very wide openings compared to the relatively small bottom opening of a conventional funnel. Therefore, when set within a canning jar, the conventional funnel is very unstable and can easily tip over spilling the hot processed food. Therefore, there is a need for a multipurpose funnel having a wide opening at the bottom to facilitate the transfer of hot processed food into a canning jar. There is still a further need for a multipurpose funnel having the means for securely resting in a canning jar, or other storage container having a wide opening, such that when the funnel is filled, the funnel does not become unstable and tip over, spilling its contents.

Another disadvantage of using conventional funnels in the canning process involves the types of food being processed. Some varieties of canned food are often thick and contain large pieces of fruit or vegetables. Therefore, if using a conventional funnel having a narrow opening at the bottom, the processed food may become stuck within the opening, thereby complicating the filling of the canning jar. While trying to dislodge the stuck piece of food, the canner may splash or spill the hot contents on himself/herself and get burned. Therefore, there is a need for a multipurpose funnel having a wide opening at the bottom to eliminate the possibility of the funnel becoming clogged.

Another disadvantage of using conventional funnels when canning is the fact that canning jars are available in many different sizes, thereby having wide openings of varying sizes. It is therefore difficult to use a single conventional funnel with different size canning jars because the funnel may not fit properly within the wide opening. As discussed above, if the funnel is not stable within the opening of the canning jar while it is being filled, the funnel would easily become off balanced and spill its contents. Therefore, there is a need for a single multipurpose funnel having the means for accommodating different size canning jars while maintaining a wide opening at the bottom end of the funnel to facilitate the filling of the canning jars and maintaining a stable structure during filling.

Another disadvantage with using conventional funnels is that these funnels do not provide a means by which air is vented out of a container being filled. That is, when pouring processed food into a canning jar via a conventional funnel, the processed food put into the jar is replacing air already located in the jar. Therefore, this replaced air must escape the jar to allow the processed food in.

Typically replaced air escapes by one of two means. First, the air escapes back up through the funnel, thereby causing a "bubble" to form and burst through the processed food contained in the funnel. Second, if due to the density of the processed food the air cannot escape back up through the funnel, the replaced air escapes by the user vibrating or shaking the funnel which causes the replaced air to escape through the jar opening, external to the funnel.

Therefore there is a need for a self venting multipurpose funnel that when used with any size canning jar opening the canner does not have to vibrate or shake the funnel as a means for releasing the replaced air in the jar. There is still a further need for a self venting multipurpose funnel that eliminates the creation of a bubble when filling ajar with processed food.

In the prior art, U.S. Pat. No. 1,612,383 to Lepeshkin describes a funnel having a plurality of channels, either protruding outwardly or inverted, extending vertically along the exterior of the funnel. The Lepeshkin patent however specifically restricts the channels to extending from the top of the funnel to a point about midway of the length of the spout. Further, the disclosed funnel is designed specifically for filling narrow mouthed bottles or receptacles.

In the prior art, U.S. Pat. No. 1,487,824 to Vincent describes a funnel having a collar secured to the upper part of the funnel's corrugated spout. This design is to provide the means by which the funnel can rest on the rim of a container's opening as well as the means for venting the funnel during its use. The Vincent patent however does not disclose nor teach a funnel for accommodating wide opening containers or jars, or a funnel that is secure and stable while engaged with the container during filling.

SUMMARY OF THE INVENTION

The present invention solves the problems of conventional funnels by improving standard funnels and providing a multipurpose funnel that accommodates wide opening containers while incorporating a means for venting the air out of a container for which a funnel is being used to fill.

In the preferred embodiment, the multipurpose funnel of the present invention comprises multiple sections, each section providing the means to securely engage a different opening width of a container. The top section(s) of the multipurpose funnel are oversized, and when coupled with a short, wide spout, result in a stable, balanced and effective funnel. In canning, the oversized top section(s) allow a canner to safely fill a container with any hot processed food without being splashed or without spilling the processed food. The short, wide spout cannot reach the bottom of a canning jar, thereby resulting in the multipurpose funnel being balanced and securely seated in the jar opening. The bottom opening of the multipurpose funnel is also wide in order to accommodate the filling of canning jars with processed food that contains chunks of fruit or vegetables. The present funnel eliminates the possibility of the funnel tipping over, getting clogged during use, spilling or splashing its contents. Therefore, the multipurpose funnel of the present invention allows canners to safely and efficiently can processed food of any consistency.

In the preferred embodiment, the venting means comprises a plurality of outwardly protruding vertical ridges. When the funnel of the present invention is placed in a container opening, the vertical ridges of the funnel contact the container opening, thereby creating a plurality of vents between the edge of the container opening and the exterior of the funnel, each vent being delineated by two vertical ridges.

In operation, as a user fills a container using a self venting multipurpose funnel of the present invention, air escapes the container via these vents. Therefore an advantage of this invention is the elimination of any bubble, or "gulping" through the funnel's openings or any need of the user to vibrate or shake the funnel during filling. This further eliminates any potential mess when filling a container. Another advantage of the funnel of the present invention is that a container is filled more rapidly and efficiently by allowing the replaced air to escape via the vents.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
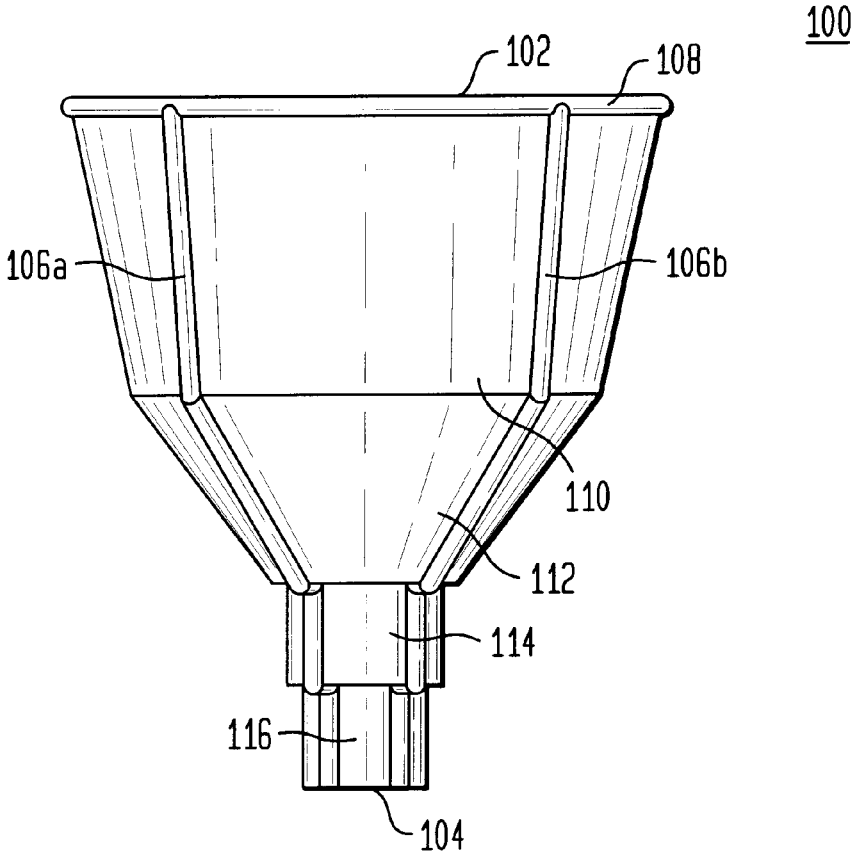
FIG. 1 is a perspective view showing a funnel of the present invention.
Figure 2:
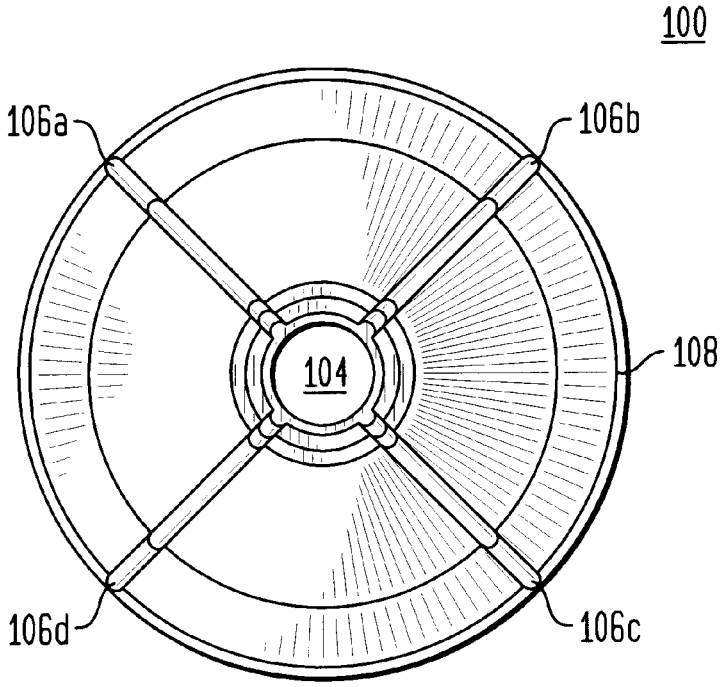
FIG. 2 is a planar view showing a bottom view of the funnel.
Figure 3:
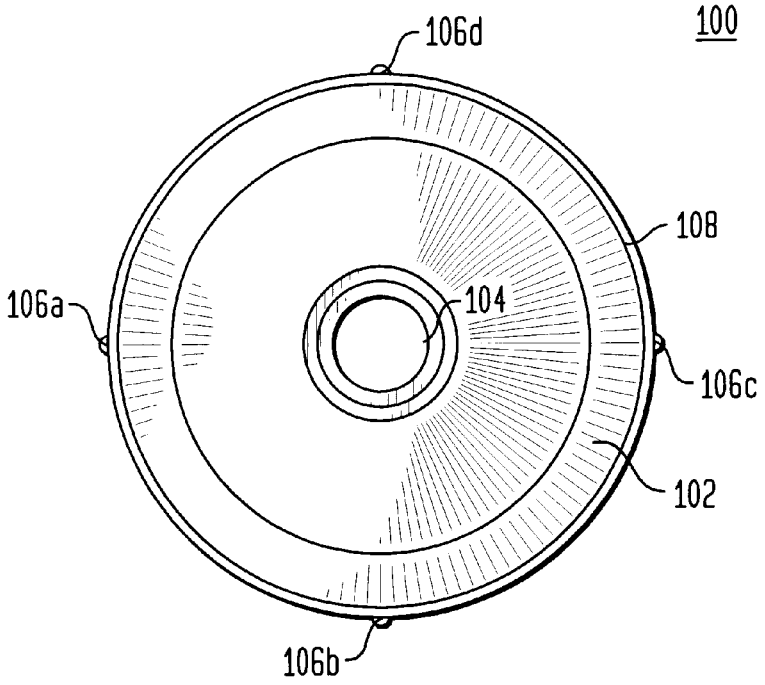
FIG. 3 is a planar view showing a top view of the funnel.
Figure 4:
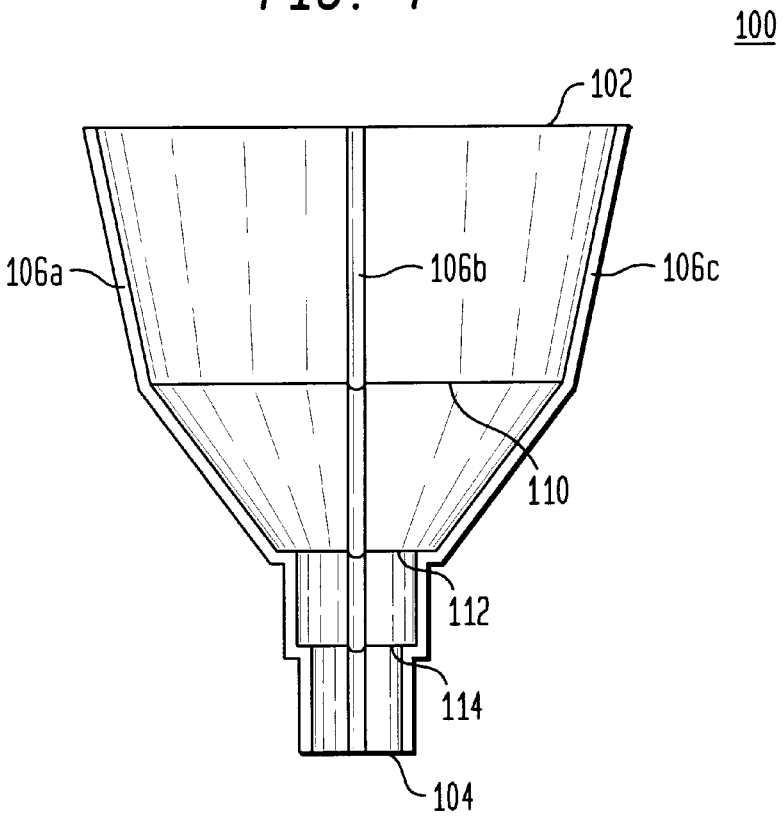
FIG. 4 is a planar view showing a side view of the funnel.

FIGS. 1–4 illustrate the preferred embodiment of a self-venting funnel 100 of the present invention. The funnel 100 has a top opening 102 and a bottom opening 104 with tapering sides resulting in the top opening 102 being greater than the bottom opening 104. The funnel 100 of the present invention also comprises a rim 108 that provides the user with an extra means of safety in that the funnel 100 is strengthened at its top edge. The improvement of this invention over conventional funnels comprises a plurality of sections 110–116 in combination with a plurality of outwardly protruding vertical ridges 106*a–d* that extend the entire length of the funnel 100 from the top opening 102 to the bottom opening 104. The length and direction of the ridges 106*a–d* is for convenience only. A comparable funnel can be designed and manufactured using ridges 106*a–d* that only extend a part of the length of the funnel 100 or that are not vertical.

The plurality of different sections 110–116 provides the means wherein each section of the funnel 100 supports a different width opening of a container 502 yet maintains a large top section, a short spout, and a wide bottom opening 104. For example, the funnel 100 shown on FIG. 1 comprises a first section 110, a second section 112 adjacently connected to the bottom of the first section 110, a third section 114 adjacently connected to the bottom of the second section 112, and a fourth section 116 adjacently connected to the bottom of the third section 114 and incorporating the bottom opening 104 of the funnel 100. As shown in the figures, the preferred embodiment of the first section 110 and the second section 112 have tapered, or angulated, sides, whereas the third section 114 and the fourth section 116 have straight, or vertical, sides.

In operation, when placing the funnel 100 in a container opening, the bottom opening 104 of the funnel 100 will extend as far down into the container as needed so as to accommodate the width of the container opening. In particular, the vertical ridges 106*a–d* of the appropriate sized stage will contact the opening 506 of the container 502.

Although not limited to exact dimensions, one embodiment of the present invention comprises the following measurements: the length of the funnel 100 is approximately 8.25 inches; the top opening 102 is approximately 8.5 inches; the length of the first section 110 is approximately 4 inches (or 49% of the total length); the length of the second section 112 is approximately 2.25 inches (or 27% of the total length); the third section 114 has a length of approximately 1 inch ( or 12% of the total length) and has an outer diameter, or opening, of approximately 2.25 inches; and the fourth section 116 has a length of approximately 1 inch (or 12% of the total length) and has a outer diameter, or bottom opening 104, of approximately 1.75 inches.

In the preferred embodiment, the diameter of the top opening 102 of the funnel 100 is approximately 95–110% of the total length of the funnel 100, the length of the first section 110 is approximately 45–55% of the total length of the funnel 100, and the diameter of the bottom opening 104 of the funnel 100 is approximately 15–35% of the diameter of the top opening 102 of the funnel 100.

Figure 7:
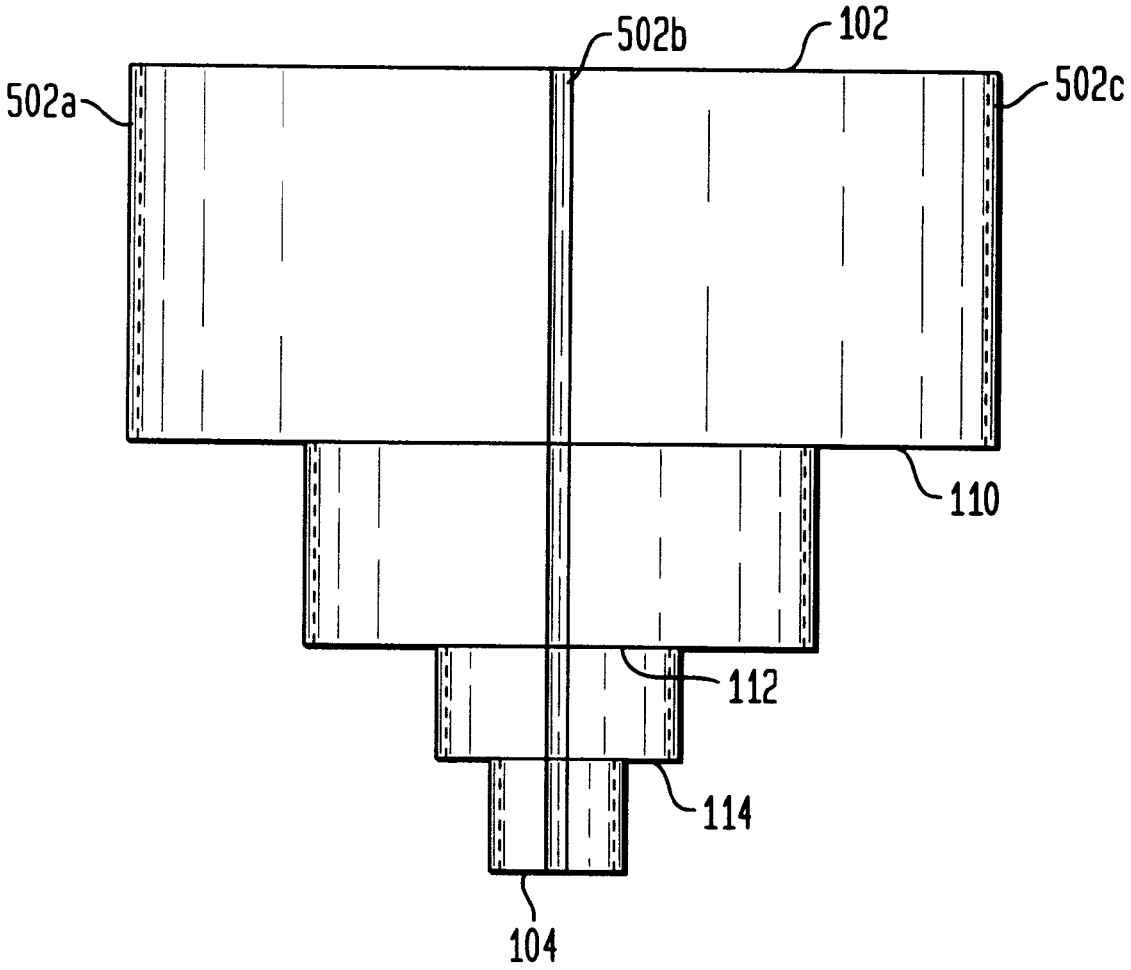
FIG. 7 is a planar side view of an alternative funnel having straight sides.

These different sections of the preferred funnel 100 are for convenience purpose only. It would be readily apparent to develop a funnel having any number of sections with either tapered or straight sides, see FIG. 7, while maintaining the same functional advantages of the present invention. For example, in an alternative embodiment, the funnel 100 comprises a top section, one or more middle sections, and a spout section. In this embodiment, the top section may comprise one or more subsections, such as, for example only, the first section 110 and/or the second section 112. The middle section may comprise one or more subsection, such as, for example only, the second section 112 and/or the third section 114. The spout section may also comprise one or more subsections, such as, for example only, the third section 114 and/or the fourth section 116. In such an alternative embodiment, the top section may comprise approximately 60–80% of the total length of the funnel.

In the preferred embodiment, the funnel 100 of the present invention comprises four vertical ridges 106*a–d* that are equal distant around the exterior of the funnel 100. In addition, in the preferred embodiment, each vertical ridge 106*a–d* is approximately 0.25 inches in width and 0.125 inches in depth. This embodiment, however, is for convenience purpose only. It would be readily apparent to one of ordinary skill in the relevant art to use any number of such vertical ridges 106*a–d*, to place them in a different arrangement on the exterior of the funnel 100, and to use vertical ridges 106*a–d* having alternative dimensions, while still maintaining the functionality of the vertical ridges 106*a–d*.

Figure 5:
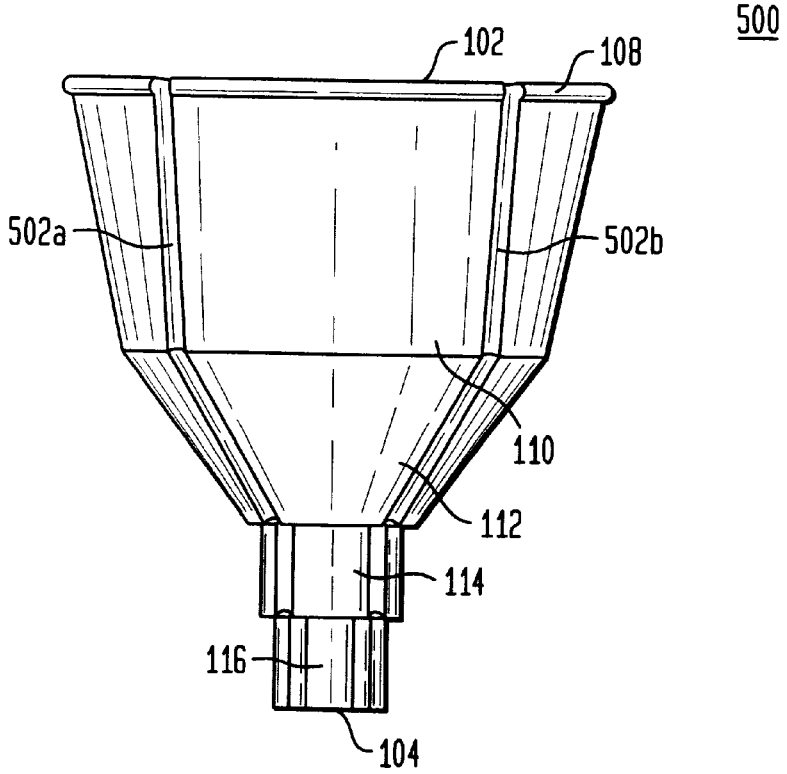
FIG. 5 is a perspective view showing an alternative funnel having inwardly protruding vertical ridges.
Figure 6:
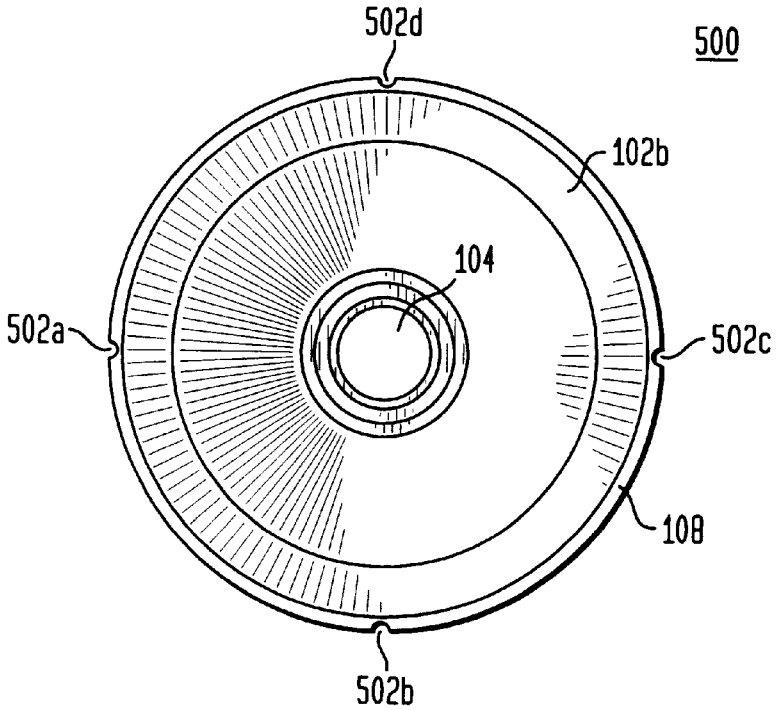
FIG. 6 is a top view of the alternative funnel.

In an alternative embodiment, FIGS. 5 and 6, the vertical ridges 106*a–d* of the funnel 100 are not protruding outwardly, but are inverted. That is, the vertical ridges 502*a–d* of this alternative embodiment protrude inwardly toward the middle of the funnel. Using this means of venting, the resulting vents comprise the ridges themselves in that when the funnel is placed in the container opening, the inverted ridges 502*a–d* make "holes" in the seam between the container and funnel. Air escapes the container via these hole vents. The size of the hole vents are directly proportional to the diameter of the inverted ridges 502*a–d*, wherein a funnel may comprise any number of inverted ridges 502*a–d* of any diameter.

In another alternative embodiment, the means for venting the funnel do not comprise vertical ridges 106*a–d,* but rather comprise one or more bumps, ripples, ledges, or other type of protrusion that creates a vent between the opening edge of the container and the exterior of the funnel. Such protrusions may protrude outwardly or be inverted. In another embodiment, the funnel may have holes through its side through which the air in the container is vented. It would be readily apparent to one of ordinary skill in the art to design, manufacture, and use a self venting funnel of the present invention that incorporates one or more of these alternate venting means.

The preferred embodiment of the funnel 100 of the present invention is made out of a hard, durable plastic that can be manufactured easily by injection molding. This method of manufacture is for convenience purpose only. It would be readily apparent for one of ordinary skill in the relevant art to make the funnel 100 out of any suitable material, e.g. metal, composites, stiff paper (for a disposable funnel), and the like. Further, the embodiment described above is described in sufficient detail to enable those skilled in the relevant art to design, manufacture, and use the funnel 100 of the present invention.

All dimensions are used in the preferred embodiment and are for convenience purpose only. It would be readily apparent to one of ordinary skill in the relevant arts to design and manufacture a funnel of the present invention using different dimensions and to use comparable materials.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. A multipurpose funnel having a total length, a top opening, a bottom opening, an exterior and an interior, for filling a wide opening container, comprising:

a first section incorporating the top opening and having a length, a top diameter, and a bottom;

a second section having a top, a top diameter and a bottom, the top of said second section attached to the bottom of said first section, the top diameter of said second section is smaller than the top diameter of said first section;

a third section having an outer diameter, a top and a bottom, the top of said third section attached to the bottom of said second section, the outer diameter of said third section is smaller than the top diameter of said second section;

a fourth section having an outer diameter, a top and incorporating the bottom opening, the top of said fourth section attached to the bottom of said third section, the outer diameter of said fourth section is smaller than the outer diameter of said third section; and a means for venting the container during filling by creating one or more vents on the on the exterior of the funnel;

wherein said first section, said second section, said third section, and said fourth section are separate and distinct sections of the funnel, and the diameter of the bottom opening of the funnel is approximately 15–35% of the diameter of the top opening of the funnel.

2. The funnel according to claim 1, wherein said means for venting is one or more outwardly protruding vertical ridges positioned on the exterior of the funnel.

3. The funnel according to claim 1, wherein said means for venting is one or more inwardly protruding vertical ridges positioned on the exterior of the funnel.

4. The funnel according to claim 1, wherein said means for venting is one or more outward protrusions.

5. The funnel according to claim 1, wherein said means for venting is one or more inward protrusions.

6. The funnel according to claim 1, wherein said first section has straight sides.

7. The funnel according to claim 1, wherein the length of said first section comprises approximately 45–55% of the total length of the funnel.

8. The funnel according to claim 1, wherein the top opening of the funnel is approximately 95–110% of the total length of the funnel.

9. The funnel according to claim 1, further comprising a rim.

10. A multipurpose funnel having a total length, a top opening, a bottom opening, an exterior and an interior, for filling a wide opening container, comprising:

a top section incorporating the top opening and having a length, a top diameter, and a bottom;

at least one middle section having a top and bottom, the top of said middle section attached to the bottom of the top section;

a spout section having an outer diameter, a top and incorporating the bottom opening, the top of said spout section attached to the bottom of said middle section, the outer diameter of said spout section is smaller than the top diameter of said top section; and a means for venting the container during filling by creating one or more vents on the exterior of the funnel;

wherein said top section, said at least one middle section, and said spout section are separate and distinct sections, and the diameter of the bottom opening of the funnel is approximately 15–35% of the diameter of the top opening of the funnel.

11. The funnel according to claim 10, wherein said means for venting is one or more outwardly protruding vertical ridges positioned on the exterior of the funnel.

12. The funnel according to claim 10, wherein said means for venting is one or more inwardly protruding vertical ridges positioned on the exterior of the funnel.

13. The funnel according to claim 10, wherein said means for venting is one or more outward protrusions.

14. The funnel according to claim 10, wherein said means for venting is one or more inward protrusions.

15. The funnel according to claim 10, wherein the length of said top section comprises approximately 60–80% of the total length of the funnel.

16. The funnel according to claim 10, wherein the top opening of the funnel is approximately 95–110% of the total length of the funnel.

17. The funnel according to claim 10, further comprising a rim.

* * * * *